US005708442A

United States Patent [19]

Whelan et al.

[11] Patent Number: 5,708,442

[45] Date of Patent: Jan. 13, 1998

[54] CORRELATION RADIOMETER IMAGING SYSTEM

[75] Inventors: David A. Whelan, McLean, Va.; Henry L. McCord, Los Angeles, Calif.

[73] Assignee: Hughes Electronics, Los Angeles, Calif.

[21] Appl. No.: 637,251

[22] Filed: Apr. 24, 1996

[51] Int. Cl.[6] ..... H01Q 3/22

[52] U.S. Cl. ..... 342/375; 342/378; 342/194

[58] Field of Search ..... 342/375, 378, 342/194

[56] References Cited

U.S. PATENT DOCUMENTS 5,585,803 12/1996 Miura et al. ..... 342/372

*Primary Examiner*—Theodore M. Blum
*Attorney, Agent, or Firm*—Leonard A. Alkov; Wanda K. Denson-Low

[57] ABSTRACT

A passive imaging system that uses an antenna having two antenna elements. The system cross-correlates received signals with a reference function to achieve high resolution. The antenna elements are rectangular with their long dimensions oriented normal to the longitudinal axis of a carrying vehicle and the elements are separated by a distance consistent with image resolution requirements. Additionally, the antenna elements are frequency scanned in the cross-track dimension. The channel for the forward antenna element has a time delay relative to that of the rear antenna element. This time delay achieves pointing of the antenna at a particular forward angle relative to the normal to the velocity vector. Outputs of IF filters of the antenna elements are synchronously detected to provide in-phase and quadrature (I/Q) components of their phase modulated product. These I/Q components are processed by an analog-to-digital converter and digitally filtered to select a phase modulation frequency band about the chosen forward angle. The real pan of the output of the digital filter is stored and is the cross-track channel signal is cross-correlated with the reference function. The output of this cross-correlation provides high along-track resolution with suppressed along-track sidelobe responses. The reference function is a weighted, limited-extent, replica of the real pan of the phase of a small-area signal as such signal passes through the forward angle. The reference function weighting suppresses correlation function sidelobes and is adjusted to include a component introduced by the bandwidths of the IF receivers, the angle extent that is used, and the separation between the antenna elements. A separate set of processing circuits is provided in parallel for each cross-track image channel at the output of the intermediate frequency (IF) amplifiers of both antenna elements. A fixed bandwidth is provided in each cross-track image channel, but the center frequency is different in order to point the beams of the antenna elements at a chosen cross-track position.

7 Claims, 2 Drawing Sheets

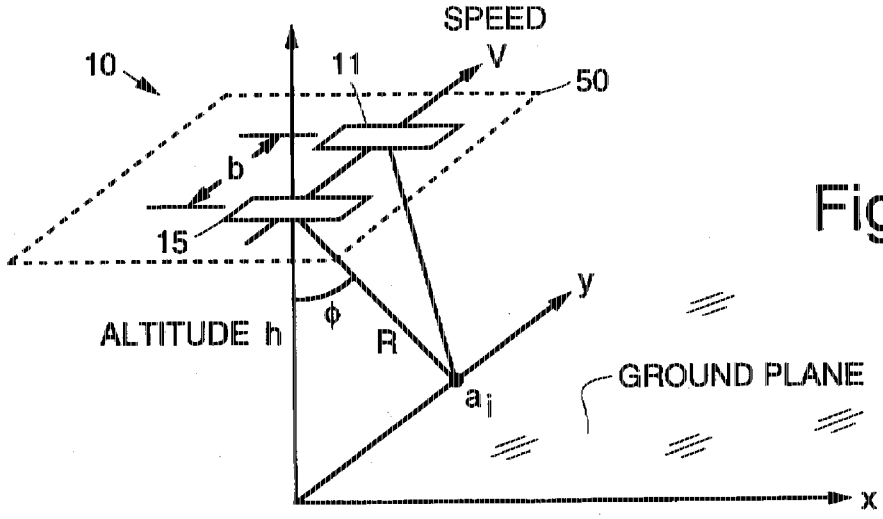
Fig. 1
Fig. 2
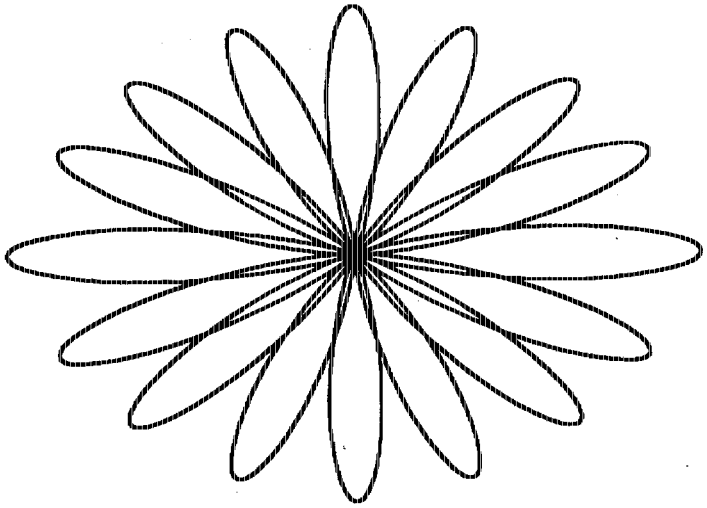
Fig. 3
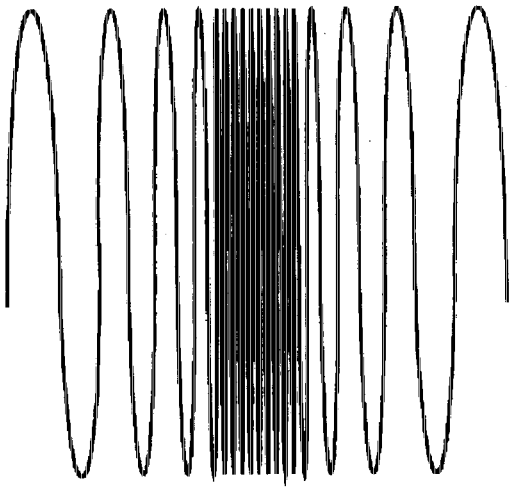

CORRELATION RADIOMETER IMAGING SYSTEM

BACKGROUND

The present invention relates to passive radar imaging systems on moving platforms, and more particularly, to a multilobe antenna array radiometer imaging system that uses correlation to provide high resolution and image quality.

Prior art relating to high resolution passive radar imaging systems include systems with large filled antenna apertures that are phase or frequency scanned to provide cross-track coverage and are moved by the radar's motion (using an aircraft or spacecraft) to provide along-track scanning. Such systems are described by King, D., "Passive Detection," Chapter 39 in Radar Handbook, M. Skolnik, ed. McGraw-Hill, New York, N.Y., 1970.

A second system is a thinned antenna array of elements with their long dimensions normal to the vehicle longitudinal axis which are phase or frequency scanned to provide cross-track coverage and whose multilobe pattern is scanned by the radar motion (using an aircraft or spacecraft) in the along-track direction. In this second type of system, high resolution images are provided in the along-track direction by correlating the signals with a reference function. This system is described by C. Edelsohn in "Synthetic Array Radiometry," presented at International Geoscience and Remote Sensing Symposium, Houston, Tex., May 1992.

A third system is a thinned array of several elements with their long dimensions parallel to the vehicle longitudinal axis whose outputs are cross-track samples of the Fourier transform of the objects on the ground and which are scanned in the along-track direction by the motion of the vehicle. In the third system, with appropriate numbers and spacing between antennas, the image high resolution cross-track image is provided by performing an inverse Fourier transform of the collected signals. This system is described by C. S. Ruf, et al, "Interferometric Synthetic Aperture Microwave Radiometry for the Remote Sensing of the Earth," IEEE Transactions on Geoscience and Remote Sensing, v. 26, n. 5, Sep. 1988.

Accordingly, it is an objective of the present invention to provide a simplified high resolution radiometer imaging system. It is another objective to provide an imaging system having a minimum of antenna array elements that is easily mounted on an aircraft or spacecraft. It is a further objective to provide an air- or space-to-ground imaging system that may be incorporated into existing radar systems. It is another objective to provide a correlation radiometer imaging system having increased bandwidth. It is yet another objective to provide a correlation radiometer imaging system having low sidelobe peaks with low total sidelobe power.

SUMMARY OF THE INVENTION

To meet the above and other objectives, the present invention provides for a correlation radiometer imaging system that uses a highly simplified antenna comprised of two small subapertures of antenna elements that form a total antenna aperture bounded by these antenna elements. The imaging system operates by cross-correlating received signals with a reference function to achieve high resolution. The quality of images produced by the imaging system is better than those of a large, filled antenna because of its desirable characteristics of the correlated impulse response in the along-track direction and its better figure of merit due to long post-detection integration times.

In the system embodiment described herein, the antenna elements are rectangular with their long dimensions oriented normal to the vehicle longitudinal axis and these elements are separated by a distance consistent with available vehicle dimensions or with the image resolution requirements. Additionally, in this system, the antenna elements are frequency scanned in the cross-track dimension. The forward antenna element channel has a time delay relative to that of the rear antenna. This time delay achieves pointing of the antenna array at a particular forward angle relative to the normal to the velocity vector.

Forward and rear antenna IF filter outputs are synchronously detected to provide in-phase and quadrature (I/Q) components of their phase modulated product. These I/Q components are processed by an analog-to-digital (A/D) converter and then digitally filtered to select a phase modulation frequency band about the chosen forward angle. This forward pointing and digital filtering provides a signal phase function having better image peak sidelobes and lower total sidelobe power than a system designed for pointing at the nadir angle.

The real part of the digital filter output is stored and is the cross-track channel signal that is cross-correlated with the reference function. The output of this cross-correlation provides high along-track resolution with suppressed along-track sidelobe responses. The reference function is a weighted, limited-extent, replica of the real part of the phase of a small-area signal as such signal passes through the forward angle. The reference function weighting is used to suppress correlation function sidelobes and is adjusted to include the component introduced by a combination of the IF bandwidths of the receivers, the angle extent that is used, and the separation of the antenna elements. The inclusion of this component of the total weighting function allows the use of a wide bandwidth with a consequently better radiometer figure of merit. A separate set of processing circuits is provided in parallel for each cross-track image channel at the output of the intermediate frequency (IF) amplifier of both the forward and rear antenna elements. In each cross-track image channel, a fixed bandwidth is provided, but the center frequency is different in order to point the antenna elements beams at the chosen cross-track position.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 illustrates the geometry associated with a correlation radiometer imaging system using two antenna elements in accordance with the invention;

FIG. 2 illustrates the real pan of the product signal produced by the correlation radiometer imaging system of FIG. 1 as a function of antenna angle using antenna elements whose gains are equal to one in the $\phi$-angle dimension;

FIG. 3 illustrates an output signal from the correlation radiometer imaging system as a function of ground track distance, centered about nadir ($\phi$=0)

DETAILED DESCRIPTION

Figure 4:
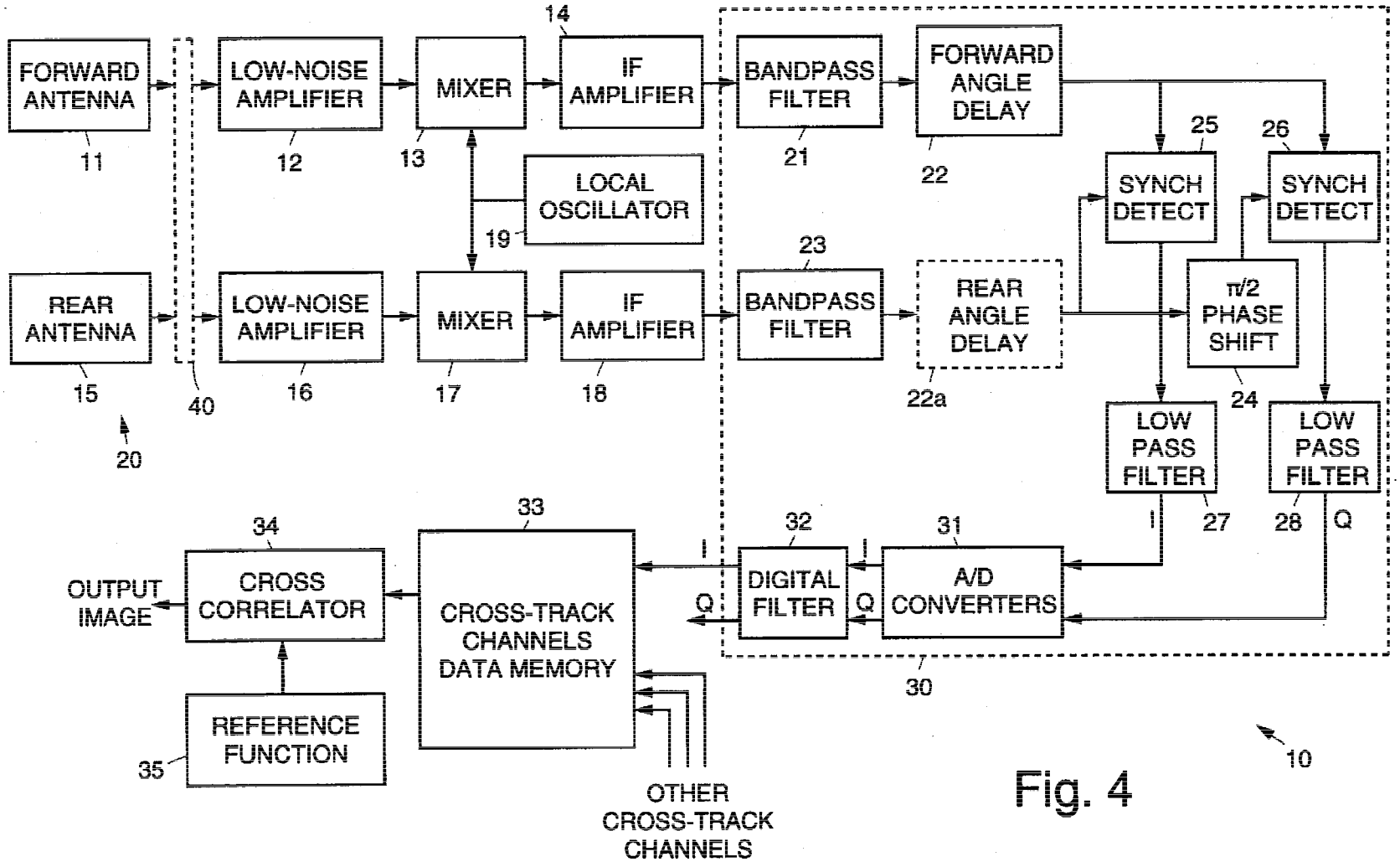
FIG. 4 is a block diagram generally illustrating a correlation radiometer imaging system in accordance with the invention that uses two antenna elements that are frequency scanned in the cross-track dimension.

Referring to FIG. 1, it illustrates the geometry of a correlation radiometer imaging system 10 in accordance with the present invention disposed on a vehicle 50 using an antenna array 10 comprising two antenna elements 11, 15 comprising forward and rear antennas elements 11, 15. The forward and rear antenna elements 11, 15 are separated by a distance, b, and are mounted with their longitudinal axes normal to the longitudinal axis of the vehicle 50 flying at an altitude, h, above a ground plane, x, y. The vehicle 50 and hence the longitudinal axis of the antenna elements 11, 15 is shown moving with a speed, v, parallel to the ground plane y-axis. An incremental ground area, $a_i$ is shown on the y-axis at an off-nadir angle, $\phi$. The angle, $\phi$, to this incremental area will vary as the antenna array 10 moves above the ground plane.

With reference to FIG. 2, it illustrates how, with isotropic antenna patterns in the $\phi$ direction, the real part of the correlation radiometer imaging system signal derived from an incremental area varies with $\phi$ in a pattern generally as shown. At large $\phi$-angles, the time required for $a_i$ to traverse a lobe of the array 20 of antenna elements 11, 15 is longer than the time required at small $\phi$-angles. This variation in traverse time produces the correlation radiometer imaging system signal that is cross-correlated. Referring to FIG. 3, it shows the general appearance of the correlation radiometer imaging system signal resulting from the incremental area, $a_i$, of FIG. 1 as it traverses pan of the pattern illustrated in FIG. 2.

With reference to FIG. 4, it is a block diagram generally illustrating the correlation radiometer imaging system 10 in accordance with the invention that uses two antenna elements 11, 15 that are frequency scanned in the cross-track dimension. The imaging system 10 is comprised a processing channel for the forward antenna 11 comprising a low noise amplifier 12, a mixer 13 that is coupled to a local oscillator 19, and an IF amplifier 14. Similarly there is a processing channel for the rear antenna 15 comprising a low noise amplifier 16, a mixer 17 that is coupled to the local oscillator 19, and an IF amplifier 18. Outputs of the respective IF amplifiers 14, 18 are processed by cross-track processing circuitry 30.

The cross-track processing circuitry 30 comprises a bandpass filter 21 and a forward angle delay 22 in the forward processing channel and a bandpass filter 23 coupled to the IF amplifier 18 of the rear processing channel. The output of the forward angle delay 22 is coupled to two synchronous detectors 25, 26, while the output of the bandpass filter 23 is coupled to a $\pi/2$ phase shifter 24 and the synchronous detector 25. Outputs of the synchronous detectors 25, 26 are coupled to two low pass filters 27, 28 that produce in-phase (I) and quadrature (Q) output signals. The I and Q output signals are coupled through an analog-to-digital (A/D) converters 31 to a digital filter 32. The output of the digital filter 32 is coupled to a cross-track channel data memory 33. The I and Q outputs of other parallel cross-track channels are also coupled to the data memory 33. The output of the data memory 33 and a reference function 35 are applied to a cross correlator 34 which cross-correlates the signals to produce an output image from the system 10.

The operation of the system 10 will be described with reference to FIG. 4. Outputs of the forward and rear antenna elements 11, 15 are amplified with the low-noise amplifiers 12, 16 and then translated down to the frequency of the IF amplifiers 14, 18 using the local oscillator 19 and mixers 13, 17. The processing circuitry 30 following the IF amplifiers 14, 18 and prior to the cross-track channels data memory 33 are required for each additional cross-track image channel. Each IF amplifier 14, 18 drives the bandpass filter 21, 23 whose center frequency is specific to the desired cross-track pointing angle because the antenna elements 11, 15 are frequency scanned to point at other cross-track positions. The bandwidth of each bandpass filter 21, 23 is fixed by the combination of the antenna element separation, the maximum antenna angle subtended by the signal correlated and the portion of the reference function weighting amplitude allocated to the effect of this combination.

The figure of merit of a radiometer is determined by $\Delta T$, the standard deviation of the measurement, given by:

$$\Delta T = \frac{T_{antenna} + T_{receiver}}{\sqrt{\Delta f_{bandpass} \cdot \tau}}$$

where $T_{antenna}$, $T_{receiver}$ are the input antenna temperature and the effective receiver noise temperature. $\Delta f_{bandpass}$ is the receiver bandwidth and $\tau$ is the integration time of the observation.

A smaller $\Delta T$ is a better figure of merit, thus, the bandwidth is one of the key parameters that can reduce $\Delta T$ and so improve the radiometer figure of merit.

The angle to an emitter relative to the absolute angle to the center of an antenna beam is called the antenna angle. The bandwidth that can be used with an antenna 11, 15 depends on the width of the antenna 11, 15 in the antenna angle direction and on the size of the antenna angle that is used. For example, with a chosen beam center at zero relative to the nadir, an element separation of three meters and a rectangular bandwidth of 100 MHz, the voltages received by the front and rear antenna elements 11, 15 from an incremental ground area at an antenna angle of 90° provide zero expected power when they are cross-correlated. However, this expected power changes smoothly as the antenna angle to the incremental area changes. In this example, as the incremental area passes through a ground point corresponding to beam center (zero antenna angle), the expected power varies as a component of the weighting of the reference signal introduced in the correlator reference function 35. Inclusion of this weighting as part of the weighting provided by the correlator sidelobes) allows a larger IF bandwidth to be used with a resulting improvement (reduction of $\Delta T$) in the figure of merit.

The time delay 22 is provided at the output of the bandpass filter 21 following the IF amplifier 14 for the forward antenna 11. The time delay 22 points the antenna beam center forward by adjusting the outputs of the antenna element 11 to be in phase at a chosen forward pointing angle. The delayed forward and rear outputs of the bandpass filters 21, 23 drive the synchronous detectors 25, 26 which provide I/Q components of the product of the delayed forward and rear signals. The output of the rear bandpass filter 23 is phase shifted by $\pi/2$ radians in the phase shifter 24 for one synchronous detector input to provide the Q component of the product output.

The I/Q outputs are passed through the low pass filters 27, 28 to reduce the subsequent required sample rate, and the output of each low pass filter 27, 28 is applied to the analog-to-digital converter 31 for processing. The digital I/Q outputs of the A/D converter 31 are sent to the digital filter 32 which passes the signals from a frequency band about the frequency corresponding to the chosen forward pointing angle. This operation provides a signal that gives improved sidelobe characteristics compared to those from a signal that is obtained from a band about the nadir angle.

The I component of the output of the digital filter 32 is sent to the data memory 33 which stores a set of samples from each cross-track channel along the flight path distance required by each channel for cross-correlation. The set of samples from each cross-track channel are then cross-correlated with the weighted reference function 35 to produce the cross-channel image sample at a particular radiometer flight path position. The weighting used in the reference function 35 includes a component due to the changing antenna angle of the incremental ground area, allowing wider bandwidths in the IF bandpass filters 21, 23 and producing a lower ΔT, as discussed above.

After the set of samples from a particular cross-track channel are read into the cross-correlator 34 and correlated with the reference function 35, the set of samples from the next cross-track channel is read into the cross-correlator 34 and correlated with the reference function 35. This process continues until all cross-track channels are correlated, by which time new signal samples have been added into the memory 33 and the oldest samples have been dropped from memory 33. In this manner, a band of cross-track channels is scanned along the ground plane in accordance with the motion of the radiometer imaging system 10 and this band of cross-track channels produces a total sampled output image that is comprised of cross-track channel image strips scanned parallel to the ground track by the motion of the radiometer imaging system 10.

A modification of the embodiment shown in FIG. 4 uses a rear angle delay 22*a* (shown in phantom) following the bandpass filter 23 to delay the rear antenna channel to point at an angle to the rear, so as to synchronously detect (25, 26) and low pass filter (27, 28) the resulting outputs of both the forward and rear bandpass filters 21, 23, and the I/Q outputs of the low pass filters 27, 28 are then passed through the digital filter 32. The digital filter 32 passes the signals from a frequency band about the frequency of the rear angle. Upon cross-correlating the I output of the digital filter 32 with the appropriate reference function 35 in the cross correlator 34, a second cross-track channel image is produced which lags the forward-angle image. The registered addition of these two images effectively doubles the bandwidth and improves the figure of merit (lowers the ΔT) of the preferred embodiment of the imaging system 10.

Alternative embodiments of the imaging system 10 will now be described. As a result of choosing configuration of the particular antenna cross-track scanning embodiment, the processing circuitry 30 following the IF amplifiers 14, 18 in FIG. 4 include the bandpass filters 21, 23, each of which has a center frequency chosen to point the antenna elements 11, 15 to the cross-track position corresponding to this center frequency. This cross-track scan embodiment has bandwidth per channel equal to that of one of the bandpass filters 21, 23. Other means for scanning the antenna elements 11, 15 in the cross-track dimension can result in greater cross-track channel bandwidths and a better figure of merit, at the cost of increased equipment complexity.

A first alternative embodiment of the system 10 involves sequentially scanning the elements 11, 15 in the cross-track dimension with varying phase or time delays laterally across the elements 11, 15. At each cross-track pointing angle, parallel channels (FIG. 4) are used (at each cross-track position) to produce parallel output signals from additional bandpass filters 21, 23, and the I/Q outputs from the low pass filters 27, 28 are added prior to A/D conversion 31 in an adder. The effect of doing this is to increase the effective bandwidth to that of the sum of the bandwidths of the bandpass filters 21, 23 used per channel. Relative to the preferred embodiment, this approach gives a wider effective bandwidth (lower ΔT). This improvement is obtained by using more complicated and expensive antenna elements 11, 15 to mechanize the phase or time-delay cross-track scanning. If the full bandwidth capability of the antennas 11, 15 and IF amplifiers 14, 18 is used in both the preferred embodiment and in this first alternative embodiment, then the number of parallel channels per cross-track position is equal to the number required for frequency scanning the cross-track pointing in the preferred embodiment.

A second alternative antenna cross-track scan embodiment employs a cross-track feed system 40 (shown in phantom) for the antenna elements 11, 15 that provides simultaneous outputs at a multiplicity of cross-track angles, in a manner such as is described by Cheston and Frank, in "Array Antennas," Chapter 11, Radar Handbook, M. Skolnik, ed., McGraw-Hill, New York, N.Y., 1970.

The second alternative embodiment uses parallel channels such as are shown in FIG. 4 to produce parallel output signals from the bandpass filters 21, 23 and wherein the I/Q outputs from the low pass filters 27, 28 are added before A/D conversion in the A/D converter 31, as in the first alternative embodiment. Again, the effect of doing this is to increase the effective bandwidth to that of the sum of the bandwidths of the bandpass filters 21, 23 used per channel. In this second alternative embodiment, however, the cross-track channels are formed simultaneously, and are not time-shared as in the first alternative embodiment. Relative to the preferred embodiment, this approach gives a wider effective bandwidth (lower ΔT) and allows a lower sample rate for the two-dimensional ground image. These improvements are obtained by using more complicated and expensive antenna elements 11, 15 and more parallel channels to simultaneously cover the cross-track positions.

Thus, the present invention provides a simplified and improved high resolution radiometer imaging system 10 in which in one arrangement, the antenna elements 11, 15 are rectangular subapertures with their long dimensions oriented normal to the vehicle longitudinal axis, separated by a predetermined distance and frequency scanned in the cross-track direction. The forward antenna channel incorporates a time delay 22 to point the antenna array 20 at a particular forward angle and separate sets of processing circuitry 30 are provided in parallel to implement a plurality of cross-track imaging channels. The system 10 is particularly applicable as a retrofit to existing radar-equipped aircraft to obtain high resolution, high quality passive images of ground objects. The system 10 also may be used in newly developed imaging applications for modern conventional wing or wing type aircraft because a minimum of equipment and antenna aperture space is required in the wing. The imaging systems 10 may be used in air-to-air, air-to-ground, ground-to-air, ground-to-spacecraft spacecraft-to-spacecraft, and spacecraft-to-ground applications. The correlation radiometer imaging system 10 may thus be used in aircraft, spacecraft, ships, land vehicles or fixed installations.

Thus, simplified and improved high resolution radiometer imaging systems have been disclosed. It is to be understood that the described embodiments are merely illustrative of some of the many specific embodiments that represent applications of the principles of the present invention. Clearly, numerous and other arrangements may be readily devised by those skilled in the art without departing from the scope of the invention.

What is claimed is:

1. A correlation radiometer imaging system for use on a moving vehicle, said system comprising:

an antenna array comprising two rectangular elements that are each frequency scanned in a cross-track dimension and that are spaced apart by a predetermine distance that determines image resolution of the system;

first amplifier means respectively coupled to the antenna elements for amplifying signals received thereby, and for translating the signals to an intermediate frequency;

second amplifier means for amplifying the intermediate frequency signals;

bandpass filter means coupled to receive the intermediate frequency signals and for selecting a plurality of frequency bands of signals about a set of frequencies corresponding to a plurality of cross-track antenna pointing angles;

delay means for pointing a plurality of cross-track channels at forward angles to provide improved along-track images;

means for multiplying the antenna element outputs to provide in-phase and quadrature components of a product produced thereby;

A/D conversion means for sampling and converting the in-phase and quadrature components to digital signals;

filter means for digitally filtering the in-phase and quadrature component samples to select a product phase modulation frequency favorable to improved image quality;

memory means for storing the in-phase component samples of the filtered product phase modulation frequency; and correlator means for cross-correlating the set of samples for each cross-track channel with a weighted reference function, which weighted reference function includes weighting effects that are a function of the bandwidth of the bandpass filter means and the spacing between antenna elements which provides for greater bandwidth and greater sensitivity of the system.

2. The system in claim 1 further comprising delay means for pointing the plurality of cross-track channels at forward angles to provide improved along-track images with lower sidelobe peaks and lower total sidelobe power.

3. The system in claim 1 wherein the weighted reference function includes weighting effects resulting from the combination of channel bandwidth and antenna element separation as part of the total reference function thus allowing greater channel bandwidth and, consequently, greater radiometer sensitivity.

4. The system in claim 1 further comprising an additional set of channels mechanized for rear pointing and image formation to provide a greater effective bandwidth of the system.

5. The system in claim 1 further comprising phase delay scanning means.

6. The system in claim 1 further comprising time delay scanning means.

7. The system in claim 1 further comprising a feed system coupled to the antenna elements for producing simultaneous images at a multiplicity of cross-track positions.

* * * * *